US009835396B1

(12) United States Patent
Sherman

(10) Patent No.: US 9,835,396 B1
(45) Date of Patent: Dec. 5, 2017

(54) SPEED-LOADING DEVICE AND METHOD FOR STORING AND RELEASING CARTRIDGES INTO MULTI-CHAMBER FIREARM

(71) Applicant: Michael Sherman, Beverly Hills, CA (US)

(72) Inventor: Michael Sherman, Beverly Hills, CA (US)

( * ) Notice: Subject to any disclaimer, the term of this patent is extended or adjusted under 35 U.S.C. 154(b) by 0 days.

(21) Appl. No.: 15/370,140

(22) Filed: Dec. 6, 2016

(51) Int. Cl.
*F41A 9/82* (2006.01)
*F41A 9/85* (2006.01)
*F41C 3/14* (2006.01)

(52) U.S. Cl.
CPC . *F41A 9/85* (2013.01); *F41C 3/14* (2013.01)

(58) Field of Classification Search
CPC ..... F41A 9/85
See application file for complete search history.

(56) References Cited

U.S. PATENT DOCUMENTS 913,393 A * 2/1909 Kellogg ..... F41A 9/85 42/89
1,231,106 A * 6/1917 Wesson ..... F41A 9/85 42/89
1,891,437 A * 12/1932 Milmore ..... F41A 9/85 42/89
3,213,559 A * 10/1965 Matich ..... F41A 9/85 206/3
4,254,571 A * 3/1981 Peter ..... F41A 9/85 42/89
4,402,153 A * 9/1983 Peter ..... F41A 9/85 42/89
4,614,053 A * 9/1986 Billman ..... F41A 9/85 42/89
4,862,622 A * 9/1989 Goyanes ..... F41A 9/85 42/89
2007/0044363 A1* 3/2007 McClellan ..... F41A 9/85 42/87

* cited by examiner

*Primary Examiner* — Gabriel Klein
(74) *Attorney, Agent, or Firm* — Spektor & Tsirkin PC; Vladimir Tsirkin

(57) ABSTRACT

A speed-loading device for loading the multi-chamber firearm, such as a revolver, by placing the axial centerlines of the cartridges over the centerlines of the chambers in the revolver's cylinder, pulling the fingertab away; thus, rapturing the tear-off portion of the first bracket and releasing the first cartridge into the firearm. By continuously pulling the tab, the sidewalls of the second and then all remaining brackets are getting pulled further apart, their openings widen and the cartridges slide off their brackets and free-fall into their respective chambers.

5 Claims, 5 Drawing Sheets

SPEED-LOADING DEVICE AND METHOD FOR STORING AND RELEASING CARTRIDGES INTO MULTI-CHAMBER FIREARM

FIELD OF THE INVENTION

The present invention relates to firearms, and, more particularly, to a speed-loading device and a method for loading small-arm rimmed cartridges into a multi-chamber firearm, such as a revolver, using one hand.

BACKGROUND OF THE INVENTION

Hand-held firearms have widely been used by the law enforcement and the military for a long time. Aside of many advantages hand-held firearms possess, there is a main disadvantage, to wit: a limited number of shots contained in one load. As a result, hand-held firearms need to be reloaded frequently, and the time spent on reloading significantly reduces the time the firearm can actually be used for firing at targets. Revolvers are particularly prone to this type of deficiency since the cartridges have to be loaded into the revolver's chambers one cartridge at a time.

There have been a number of patents, patent applications and non-patent publications describing various types of loaders for revolver-type firearms, but none has thus far provided a non-complicated, low cost, single-use loading device for revolvers that provides for releasing cartridges into multiple chambers of the gun nearly simultaneously and with one hand. The present invention seeks to lower the cost of production, and improve the loading method through a faster, single-motion loading device and method.

The U.S. Pat. No. 2,637,930 ("the '930 patent") describes a reloading clip for revolvers. The device is expensive, bulky, has moving parts and non-disposable. A somewhat similar invention described in the '845 patent is based on the same principles as the present invention, but that device is bulky, contains unnecessary complexity, such as a latch and a knob, and uses a two-hands operation. In addition, the device described in the '845 patent does not secure a rim or a flange of the cartridge, which causes the device to rely on the grasp only, which, in turn, requires the device to be as wide as one-half of the cartridge's length, comparing to no more than one-third of the cartridge's length of the devise offered by the present invention. Noteworthy is the U.S. Pat. No. 2,073,436 ("the '436 patent") as it too offers speed-loading mechanism. This device of the '436 patent, however, has moving parts, made out of metal, and cannot be used with rimmed cartridges. In sum, the prior art devices are complex, non-intuitive in operation, and expensive. Thus, a simple and inexpensive speed loading device is desired.

SUMMARY OF THE INVENTION

A speed-loading device comprises a disposable annular body formed by a plurality of integrally linked annular brackets adapted to receive and hold rimmed cartridges by clipping around a partial circumference of each cartridge. The body of each bracket is interrupted by an opening, and the first annular bracket also comprises a finger-pulling tab and a tear-off portion. When loading the multi-chamber firearm, such as a revolver, the axial centerlines of the cartridges are placed over the centerlines of the chambers in the revolver's cylinder, the fingertab is pulled away; thus, causing the tear-off portion of the first bracket to rapture and release the first cartridge into the firearm. By continuously pulling the tab, the sidewalls of the second and then all remaining brackets are getting pulled further apart, their openings widen, the brackets are pulled out of under the cartridges and the cartridges free-fall into their respective chambers. Once all the cartridges are released, the loading device may be disposed.

Each of the plurality of annular brackets has an upper opening, a bottom opening, a diameter necessary to precisely fit a cartridge, a side opening formed by resilient side tabs, and a given width significantly smaller that the length of the cartridge causing a substantial portion of the cartridge to be protruding through the bottom opening of the annular bracket. The upper portion of the annular bracket is adopted to receive and house a rim portion of the cartridge and comprises a spotface area and a plurality of inwardly sloping latching pins that prevent the cartridge from being accidently displaced from the annular bracket.

The contour of the annular body, as well as the number and the size of the annular brackets are chosen based on the cylinder of firearm to be loaded. All of the annular brackets comprising a given annular body are of the same shape and dimensions. In addition, the first annular bracket that, unlike the rest of the brackets, also comprises a finger-pulling tab and a tear-off portion. The tear-off portion comprises a tear off means due to a reduced thickness, perforations, or both. The annular brackets are linked one to another by integral links molded from the same material and of substantially the same width as the rest of the annular body.

A three-finger method for loading a multi-chamber firearm using the speed-loading device described herein is provided. To be loaded into the annular bracket, a cartridge is pushed into the annular bracket through the upper opening causing the bottom of the cartridge to protrude through the lower opening of the bracket. Once the rim portion of the cartridge reaches the sloping pins, the rim begins moving laterally pressing into said resilient side tabs. Under the pressure of the laterally moving cartridge the side tabs extend outwardly causing the rim of the cartridge to pass the sloping pins and into the space between the spotface and the sloping pins. The resilient side tabs contract inwardly to their original position grasping the cartridge and causing it to move back to the center of the bracket and its rim to rest onto the spotface, at which point the cartridge is considered fully secured in the annular bracket.

The finger-pulling tab is attached to the first annular bracket near the tear-off portion, so that when a user places protruding portions of the cartridges into the revolver's chambers and pulls the finger-pulling tab away from the annular body, the tear-off portion raptures opening the annular body and causing the first cartridge to free-fall into its designated chamber. By continually applying the outward pull, the user causes the rest of the brackets to bent outward causing the brackets to slide out and away from under the remaining cartridges, so that the cartridges free-fall into their respective chambers. It is noteworthy that the foregoing operation can be done by only three fingers of one hand.

BRIEF DESCRIPTION OF THE DRAWINGS

These and other features of this invention will be more readily understood from the following detailed description of the various aspects of the invention taken in conjunction with the accompanying drawings.

DETAILED DESCRIPTION OF THE INVENTION

The following is a detailed description of the invention provided to aid those skilled in the art in practicing in the field of the present invention. Those of ordinary skill in the art may make modifications and variations in the embodiments described herein without departing from the spirit or scope of the present invention. Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. All publications, patent applications, patents, figures and other references mentioned herein are expressly incorporated by reference in their entirety.

Figure 1:
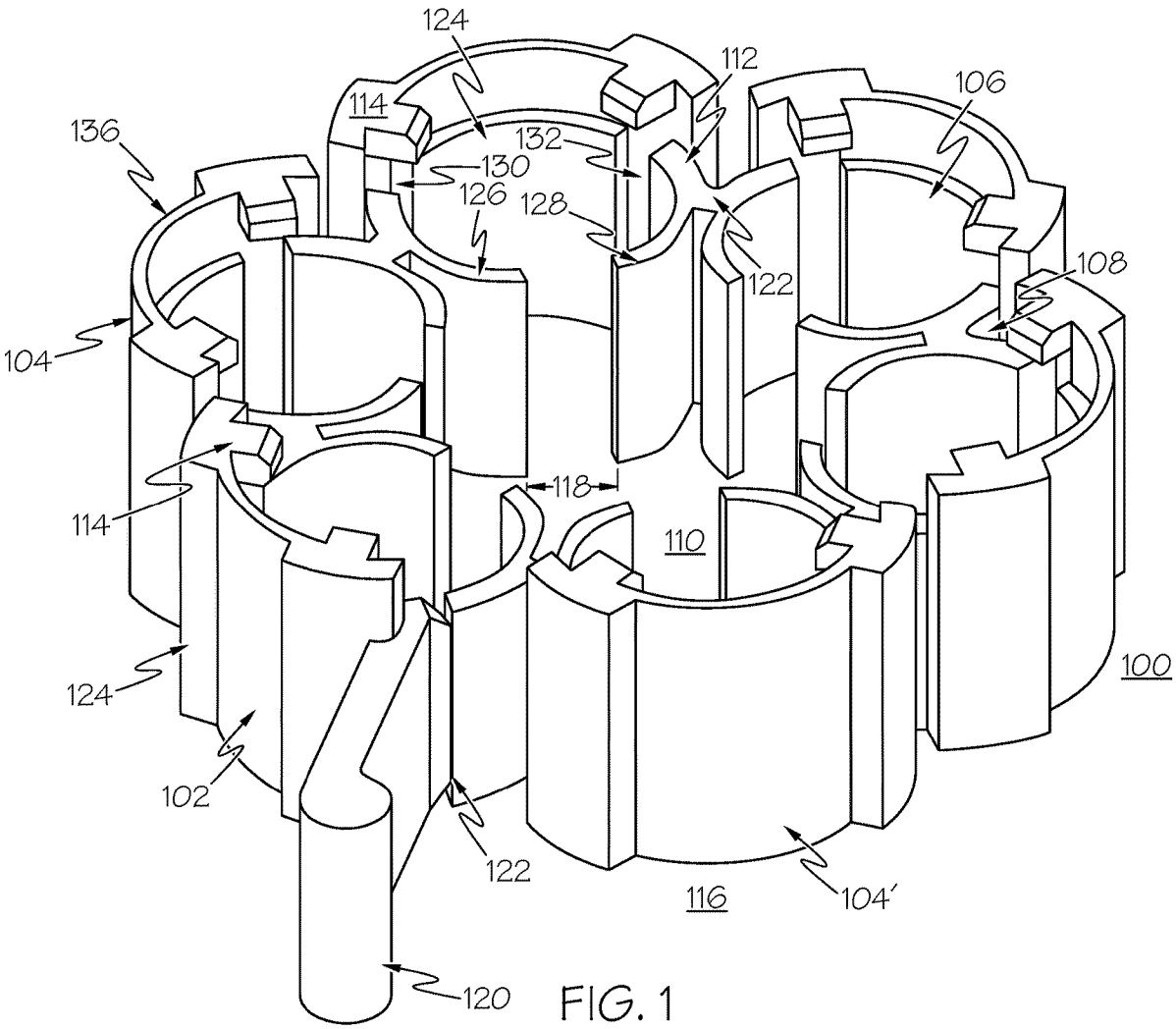
FIG. 1 is a top perspective view of the unloaded speed-loading device.

Referring to FIG. 1, the speed-loading device comprises the disposable annular body 100 formed by the first annular bracket 102, integrally linked to a plurality of integrally linked consecutive annular brackets 104-104'; said brackets 102 and 104-104' have a diameter adapted to receive and hold rimmed cartridges by clipping around a partial circumference of each cartridge. The device, including its components, is made from pliable yet sufficiently resilient and flexible plastic resins, such as nylon, polyurethane, polypropylene, and others. Each annular bracket comprises an inner portion 106, and outer portion 108, an upper opening 110, an spotface portion 112, a plurality of latching pins 114, a lower opening 116 and a side opening 118. The first annular bracket 102 also comprises a finger-pulling tab 120 and a tear-off portion 122.

Said brackets 102 and 104-104' are linked to one another by integral links 122 placed substantially opposite from each other at approximately 90 degrees from the centerline of the side opening 118. The links 122 preferably have the same width as the brackets they connect, so that the annular brackets remain planar and annular body 100 resistant to twists.

In some embodiments, the inner portion 106 of each annular bracket is formed by preferably three cylindrically curved tab members, a back tab 124, a left tab 126, and a right tab 128 (collectively, the side tabs), while in others the annular bracket may be in form of a bushing having the diameter sufficient to accommodate and grasp the cartridge 202; said bushing further comprises a side opening and a flange section.

Said tabs 124, 126 and 128 are of substantially equal width and curvature, and each comprises an upper portion, a bottom portion and respective right and left side portions.

Figure 2:
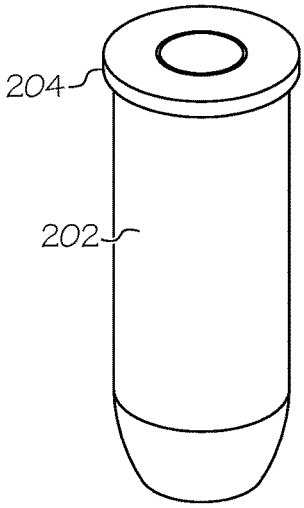
FIG. 2 is a top perspective view of a conventional rimmed cartridge.

The back tab 124 is integrally linked by links 130 and 132 with the side tabs 126 and 128; thus, forming a partial circumference adapted to fit in the cartridge 202, FIG. 2. Referring back to FIG. 1, the tabs 124, 126 and 128 are made of pliable yet sufficiently resilient plastic resin in order to provide sufficient grip of the cartridge placed into the bracket. In some embodiments, the links 130 and 132 may have a reduced thickness comparing to the thickness of the tabs 124, 126 and 128. The side opening 118 between proximate ends of the side tabs 126 and 128 forms a sector of substantially 90 degrees. The links 130 and 132, and the opening 118 are designed to facilitate bending and opening of the brackets 102 and 104-104' when outward pull is applied.

In some embodiments, the upper portion of the back tab 124 extending into a skirt 136 is provided for the purposes of preventing axial movement of the rim 204 and accidental extraction of the cartridge 202, FIG. 2, out of the annular bracket.

Back to FIG. 1, the upper portions of tabs 124, 126 and 128 are flush with one another to form the spotface portion 112 adapted to house the lower portion of the rim 204, FIG. 2. The plurality of the inwardly sloping latching pins 114 are extended over the spotface portion 112 at a distance sufficient to adapt the width of the rim 204. In some embodiments, said plurality of pins 114 may be molded into the skirt 136, while in other embodiments the pins 114 may be extended off of the ribs 138 molded to the outer portion of the back tab 124.

As it applies to the first bracket 102 only, the tear-off portion 122 is located between the proximate ends of the back tab 124 and the left tab 126, and comprises a tear off means due to a reduced thickness, or perforation, or both. The finger-pulling tab 120 is securely attached to the back tab 124 proximately to the tear-off portion 122.

Figure 3:
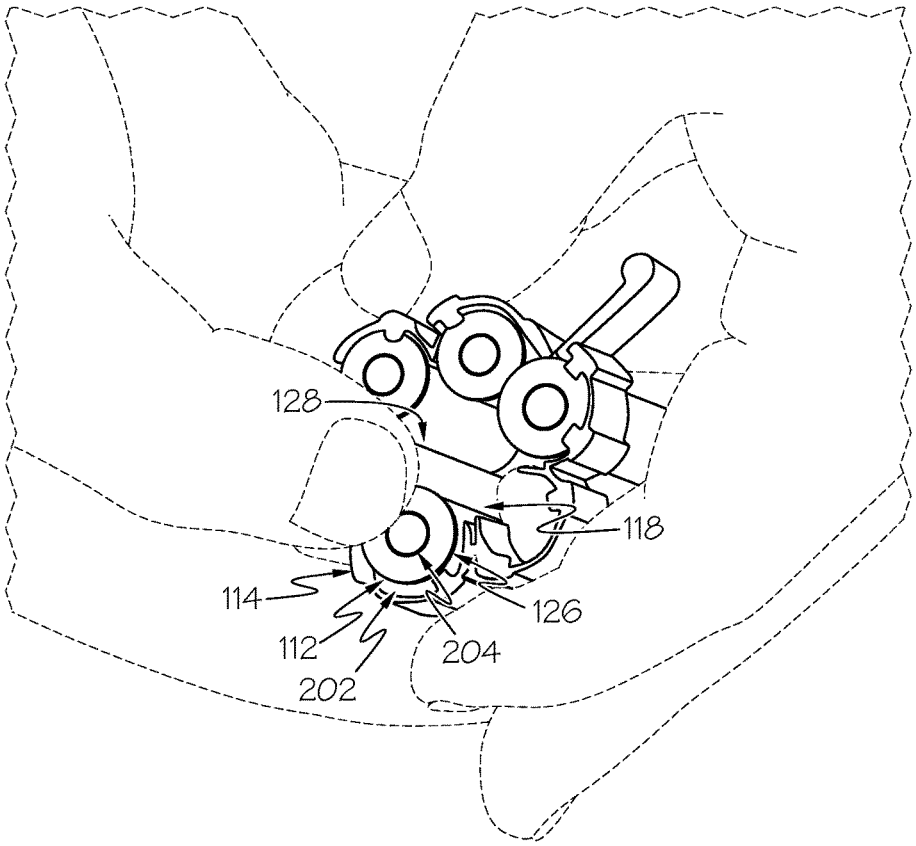
FIG. 3 shows the process of loading cartridges into the speed-loading device.

Referring now to FIG. 3, when the cartridge 202 is pushed down the upper opening of the brackets 102 or 104, proximate ends of the side tabs 126 and 128 are spread apart causing the side opening 118 to widen; the rim 204 slides down the sloping latching pins 114, and cartridge 202 gets secured once the rim 204 is fully rested on the spotface portion 112.

Figure 4:
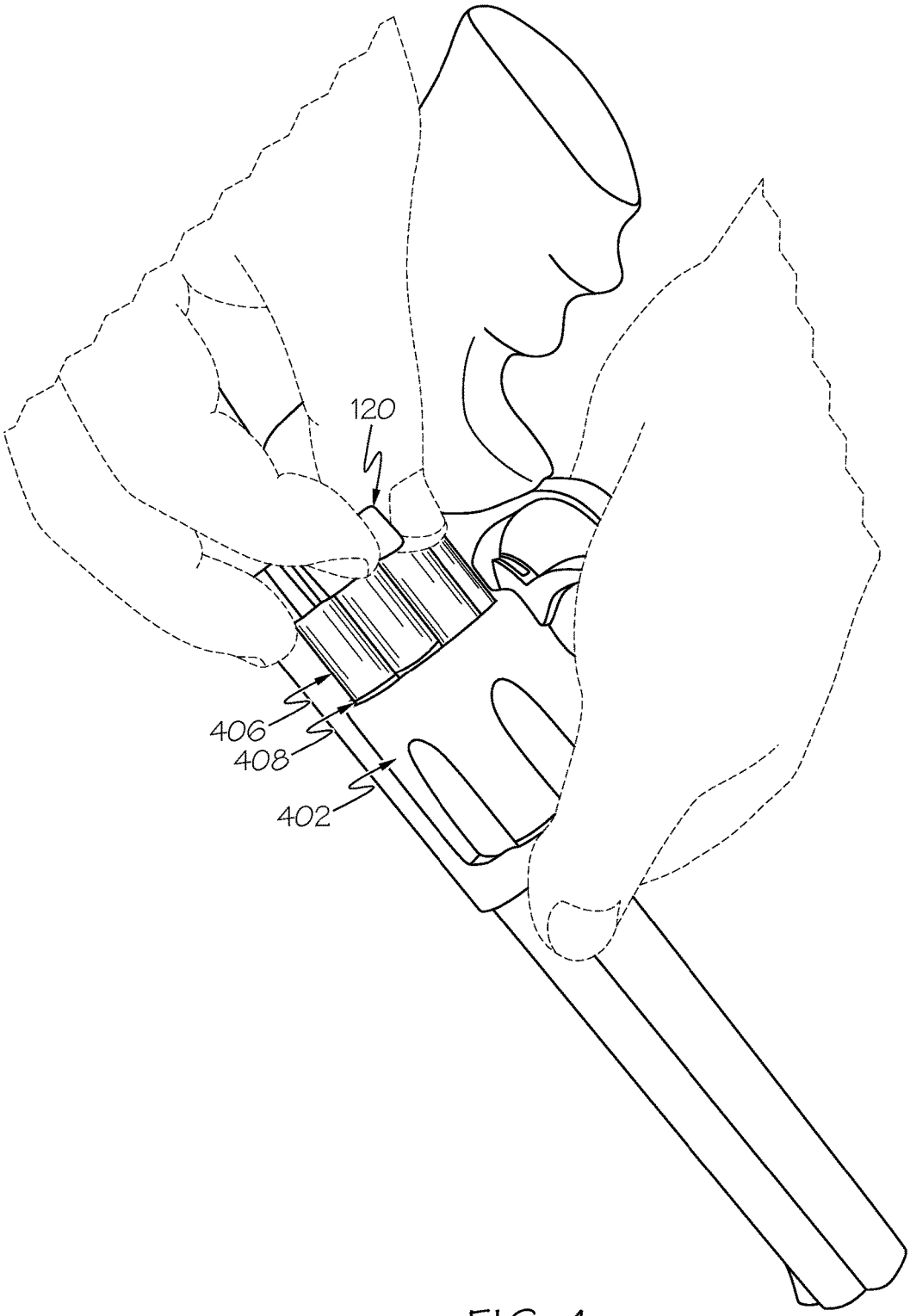
FIG. 4 illustrates the process of placing the loaded speed-loading device onto the revolver's cylinder.

Referring now to FIG. 4, once the cartridges are loaded into their respective annular brackets, the speed-loading device is positioned over the revolver's cylinder 402 such that the protruding portion 406 of each cartridge is placed into its corresponding chamber 408, and the finger-pulling tab 120 is grasped by the thumb and forefinger of the user.

Figure 5:
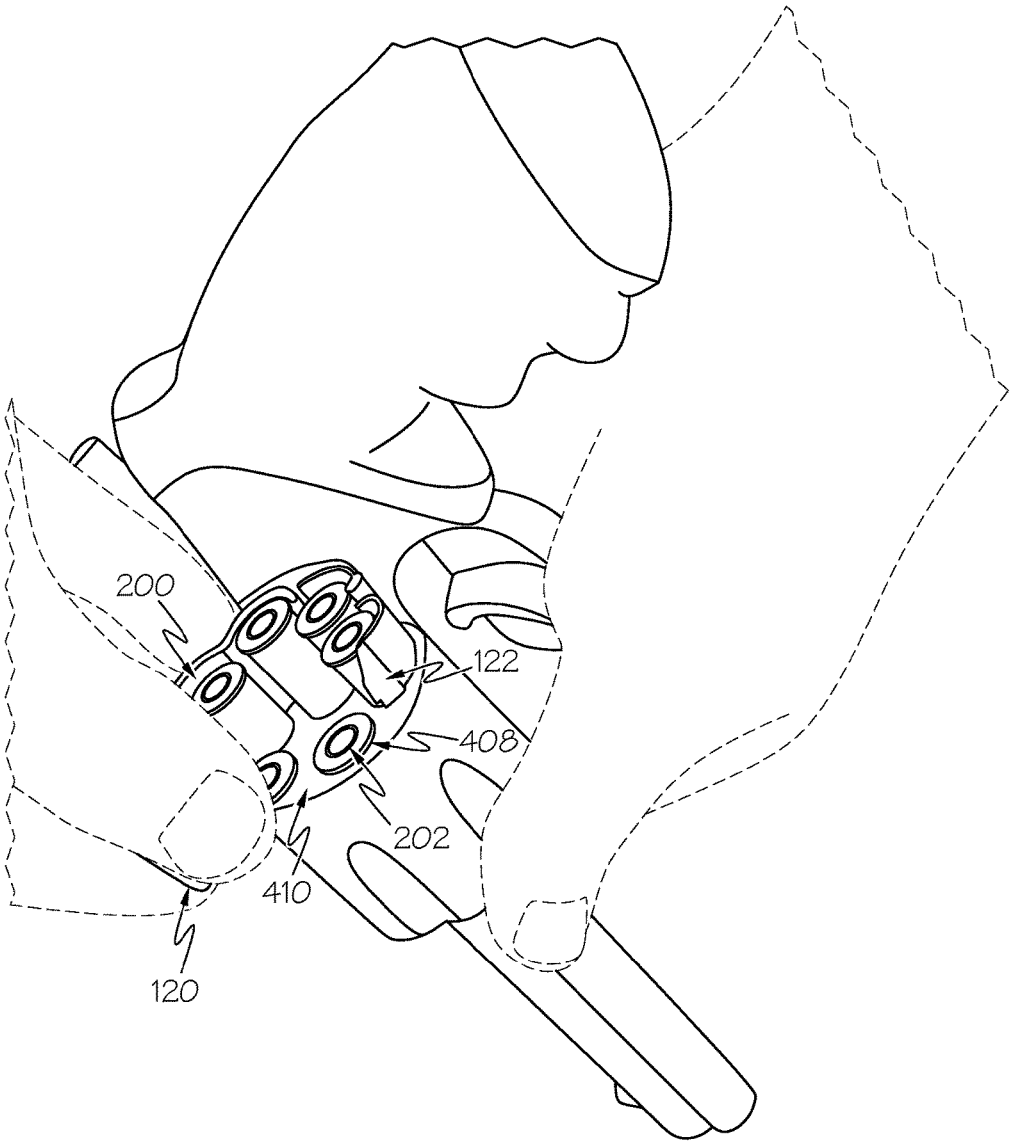
FIG. 5 shows the initiating step of the three-finger operational method of the present invention.

Referring now to FIG. 5, the finger-pulling tab 120 is pulled outwardly causing a drum 410 to rotate and the tear-off portion 122 to rapture, which, in turn, breaks the annular body 100 and opens the first annular bracket. At that point, the first bracket loses its grip over the cartridge, the spotface portion releases the rim, and cartridge 202 free falls into its designated chamber 408. To prevent accidental displacement of the speed-loading device off of the drum 410, any of the remaining fingers of the same hand can be used to continuously pressing the speed-loading device against the cylinder.

Figure 6:
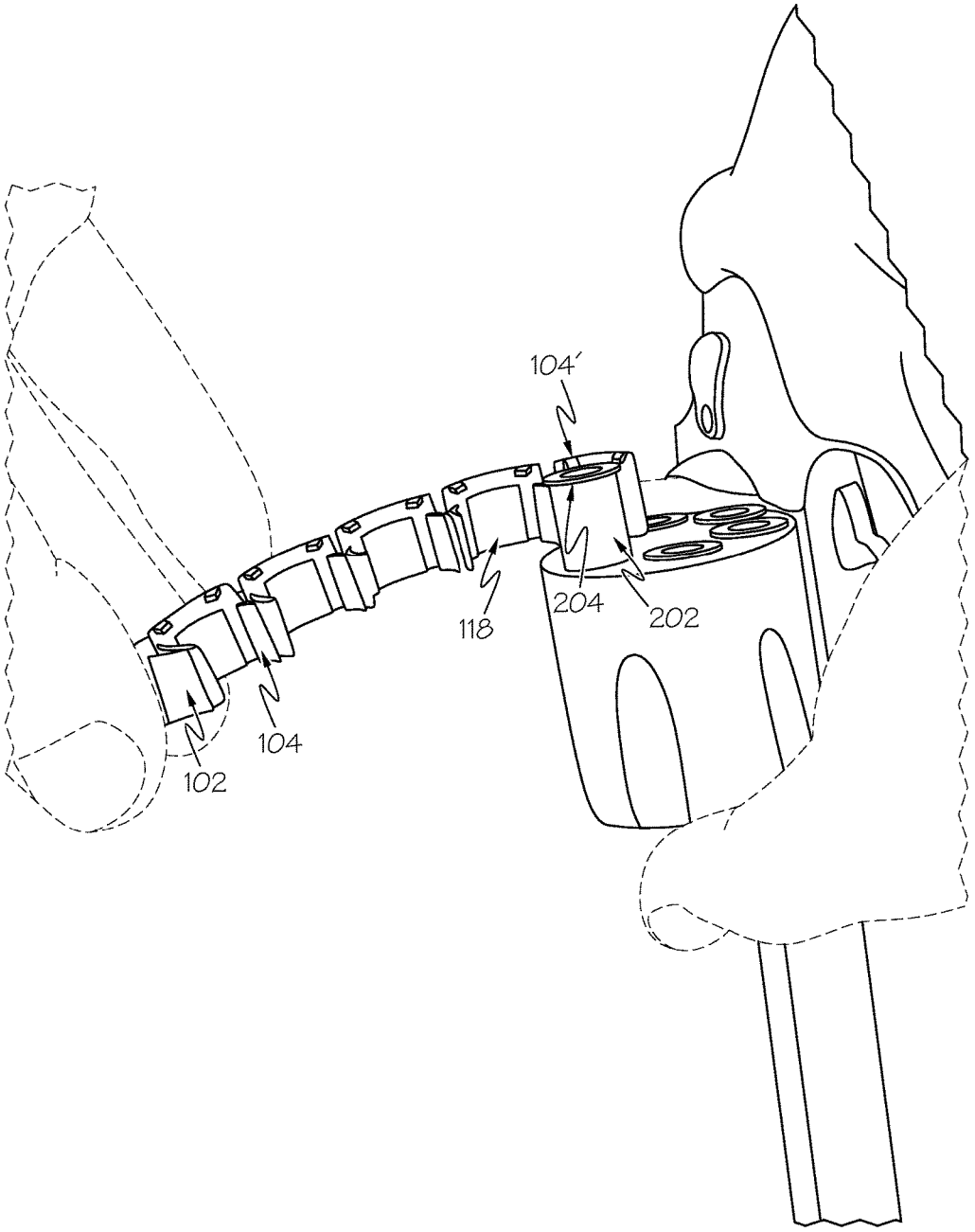
FIG. 6 depicts the completing step of the three-finger operational method of the present invention.

Referring now to FIG. 6, by continuing the outward pull, the second and all consecutive brackets 104-104' are pulled outwardly, which causes the side openings 118 to widen and the bracket 104 to slide out from under the rim 204, at which point the cartridge 202 free-falls into its designated chamber. The foregoing process is repeating until the last cartridge is released.

To reiterate, the embodiments were chosen and described in order to best explain the principles of the invention, the practical application, and to enable others of ordinary skill in the art to understand the invention. Various other embodiments having various modifications may be suited to a particular use contemplated, but may be within the scope of the present invention.

What is claimed is:

1. A multi-chamber firearm speed-loading device comprising:

an annular body formed by a first annular bracket integrally linked to a plurality of integrally linked consecutive annular brackets, said first annular bracket and said linked consecutive annular brackets are of a given width having a diameter adapted to receive and hold rimmed firearm cartridges of a given length and caliber, wherein said first annular bracket and each of said consecutive annular brackets further comprise a side opening, an upper opening, a lower opening, a spotface portion, and a plurality of latching pins;

a finger-pulling tab attached to said first annular bracket;

a tear-off portion formed in said first annular bracket by a tear off means;

wherein said first annular bracket and each of said consecutive annular brackets further comprise an inner portion formed by a cylindrically curved back tab member integrally linked to two cylindrically curved side tab members; and wherein said cylindrically curved back tab member extends into a skirt for preventing axial movements and accidental discharge of said cartridges.

2. The speed-loading device of claim 1 wherein each of said side openings forms a sector of substantially 90 degrees.

3. The speed-loading device of claim 1 wherein said width of said first annular bracket and said plurality of said consecutive annular brackets does not exceed substantially one-third of said length of said cartridges.

4. A method for loading a multi-chamber firearm, said method comprising:

providing speed-loading device comprising an annular body formed by a first annular bracket integrally linked to a plurality of integrally linked consecutive annular brackets, said first annular bracket and said linked consecutive annular brackets are of a given width having a diameter adapted to receive and hold rimmed firearm cartridges of a given length and caliber, wherein said first annular bracket and each of said consecutive annular brackets further comprise a side opening, an upper opening, a lower opening, a spotface portion, a plurality of latching pins, a finger-pulling tab attached to said first annular bracket, and a tear-off portion formed in said first annular bracket by a tear off means;

placing a rimmed cartridge into said first annular bracket by sliding said cartridge through said upper opening and pressing said cartridge against said side opening until said cartridge's rim rests between said spotface portion and said plurality of said latching pins such that a majority of said cartridge protrudes from said lower opening;

placing a plurality of said rimmed cartridges into said plurality of said consecutive annular brackets by sliding each cartridge through said upper opening and pressing said cartridge against said side opening until said cartridge's rim rests between said spotface portion and said plurality of said latching pins such that a majority of said cartridge protrudes from said lower opening;

placing said annular body over a cylinder of said multi-chamber firearm with said brackets' lower openings resting on said cylinder such that the protruding portions of said cartridges project into the chambers of said cylinder, wherein placing said annular body over said cylinder is done with three fingers of the same hand;

pulling away said finger-pulling tab while pushing said annular body against said cylinder, wherein pulling away said finger-pulling tab is done with two fingers of the same hand while continuously pushing said annular body against said cylinder with any remaining fingers of the same hand;

rupturing said tear-off portion and sliding said cartridges through said side openings from under and out of each of said annular brackets; thus, causing said cartridges to fall into respective chambers of said cylinder; and disposing of said speed-loading device.

5. The method of claim 4 wherein not less than two-third of said length of said cartridges protrude through said lower opening of each annular bracket.

* * * * *